US009708898B2

(12) United States Patent
Milner et al.

(10) Patent No.: US 9,708,898 B2
(45) Date of Patent: Jul. 18, 2017

(54) INFLUX DETECTION AT PUMPS STOP EVENTS DURING WELL DRILLING

(71) Applicant: COVAR APPLIED TECHNOLOGIES, INC., McLean, VA (US)

(72) Inventors: George Martin Milner, Round Rock, TX (US); Brian Anstey Tarr, Houston, TX (US)

(73) Assignee: CoVar Applied Technologies, Inc., McLean, VA (US)

( * ) Notice: Subject to any disclaimer, the term of this patent is extended or adjusted under 35 U.S.C. 154(b) by 584 days.

(21) Appl. No.: 14/284,013

(22) Filed: May 21, 2014

(65) Prior Publication Data

US 2014/0345940 A1 Nov. 27, 2014

Related U.S. Application Data

(60) Provisional application No. 61/826,690, filed on May 23, 2013.

(51) Int. Cl.

| | |
|---|---|
| ***G01N 15/08*** | (2006.01) |
| ***E21B 44/00*** | (2006.01) |
| ***E21B 41/00*** | (2006.01) |
| ***E21B 47/10*** | (2012.01) |
| ***E21B 21/08*** | (2006.01) |

(52) U.S. Cl.

CPC ..... *E21B 44/00* (2013.01); *E21B 21/08* (2013.01); *E21B 41/0092* (2013.01); *E21B 47/10* (2013.01)

(58) Field of Classification Search

CPC ..... E21B 21/08; E21B 41/0092; E21B 44/00; E21B 47/10

USPC ..... 702/12, 47, 50; 175/25; 166/264; 73/152.21

See application file for complete search history.

(56) References Cited

U.S. PATENT DOCUMENTS

| | | | | |
|---|---|---|---|---|
| 4,553,429 | A | 11/1985 | Evans et al. | |
| 5,205,165 | A | 4/1993 | Jardine et al. | |
| 6,234,250 | B1 | 5/2001 | Green | |
| 6,484,816 | B1 * | 11/2002 | Koederitz | E21B 21/08 175/25 |
| 9,033,048 | B2 * | 5/2015 | Judge | E21B 21/08 166/264 |
| 2012/0241217 | A1 | 9/2012 | Davis et al. | |

OTHER PUBLICATIONS

Ali et al., "Automated Alarms for Smart Flowback Fingerprinting and Early Kick Detection", SPE/IADC 163474 (2013), pp. 1-9.

* cited by examiner

*Primary Examiner* — John H Le

(74) *Attorney, Agent, or Firm* — Gregory L. Porter; Andrews Kurth Kenyon LLP

(57) ABSTRACT

An automated system for detecting fluid influx into a wellbore during the transient conditions that occur after pumps stopped. The system comprises at least one sensor normally employed on a drilling rig for measuring at least one parameter, and a processor for receiving a signal indicative of the parameter from the sensor. The processor is programmed to analyze a plurality of values of the parameter measured during a plurality of previous events so as to generate a predetermined threshold value, compare the received signal to the predetermined threshold value, and provide an output signal indicative of fluid influx when the received signal is beyond the predetermined threshold value.

22 Claims, 1 Drawing Sheet

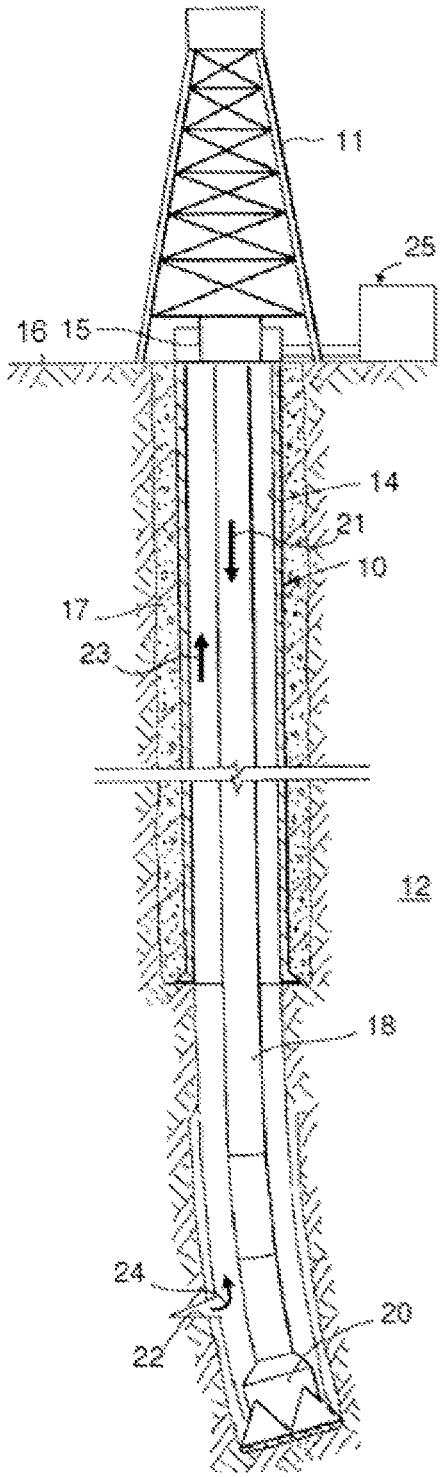
11
25
16
15
14
21
10
17
23
12
18
24
20
22

INFLUX DETECTION AT PUMPS STOP EVENTS DURING WELL DRILLING

RELATED CASES

This application claims the benefit of U.S. Provisional Application No. 61/826,690, filed on May 23, 2013, which is incorporated herein by reference.

FIELD OF THE INVENTION

The present invention relates to an alarm system methodology for detecting fluid influx into a well during a pumps off transient event during the well drilling process. More particularly, the present invention relates to an automatic, adaptive system that can respond to a changing environment and can use feedback to improve its accuracy.

BACKGROUND OF THE INVENTION

As is well known in the art, production of hydrocarbons from subsurface formations typically entails using a drill-bit to drill a borehole that reaches the desired subsurface formation. In most cases, the bit is at the remote end of a length of tubing and drills a borehole that is somewhat larger than the tubing diameter, forming an annulus between the borehole and the outside of the tubing. Drilling fluid, also referred to as "mud," is pumped down the tubing, flows out through the bit, and returns to the surface via the annulus, carrying with it the cuttings from the borehole bottom. The mud density or "mud weight" may vary for a number of reasons, including but not limited to changes in the quantity and density of cuttings; changes in the pressure applied at the surface, changes in temperature, etc.

Variations in mud density may also occur when gas or liquid enter the borehole from the formation. Because the formation fluid is unlikely to have the same density as the mud in the hole, such influx, known as a "kick," is likely to cause a change in the pressure in the annulus. By way of example, if formation fluids having a significantly lower density than the drilling mud flow into the annulus and displace the mud therein, the pressure at the bottom of the hole will drop. If not controlled, this may in turn cause an unexpected flow of formation fluids to the surface, sometimes referred to as a "blowout."

Underbalanced drilling, in which the mud pressure at the bottom of the hole is less than the formation pressure, can cause a kick. At the same time, an overbalance of mud pressure versus formation pressure tends to decrease the drilling rate and increase lost circulation and differential sticking. Thus, balanced drilling often allows only a small margin between effective pressure control and a threatened blowout and influx detection is an important aspect of drilling control.

Some common techniques for detecting unexpected changes in formation pressure are based on measurement of drilling parameters such as drilling rate, torque and drag; drilling mud parameters such as mud gas, cuttings, flow line mud weight, flow line temperature, mud pit level, and mud flow rate; and shale cutting parameters such as bulk density, shale factor, volume and size of cuttings. A drawback of some of these measurements is that they are not available in real-time because of the need to wait while fluid from the hole bottom returns to the surface. Other known methods for identifying possible kicks rely on density measurements of the borehole fluid. A drawback of these methods they are not always sufficiently sensitive to provide warning of an imminent gas kick.

Generally available kick detection systems are designed primarily for detecting kicks during pumps-on activities. Nonetheless, a kick may occur while the mud pumps are turned off, e.g. during the time required to add another length of pipe; also known as making a connection. During a pumps off event, bottom hole pressure in the wellbore will decrease due to loss of the frictional component of total equivalent circulating density (ECD). ECD being made up of three components; static fluid density, cuttings loading density and return annulus frictional pressure (expressed as equivalent density) exerted when pumps are running. The mud flow out of the well will transition (over a period of seconds or minutes) from normal pumps on flow rate to zero. If there is a change in the normal shape of the transient mud flow out response, after pumps stopped, this could indicate formation influx into wellbore.

Regardless of the criteria they use, most existing influx or kick detection systems require interaction with an operator to perform successfully. For example, it is not uncommon for a system to require manual adjustment of alarm settings in order to keep up with changes in well conditions. In order to decrease response time and to reduce or eliminate the possibility of human error, it would be desirable to provide a system that operates automatically.

Thus, a need remains for a system and method for accurately and automatically predicting imminent kicks and for detecting kicks during pumps-off events.

SUMMARY OF THE INVENTION

In accordance with preferred embodiments of the invention there is provided an automated system for detecting fluid influx into a wellbore, comprising at least one sensor normally employed on a drilling rig for measuring at least one parameter and a processor for receiving a signal indicative of that parameter from the sensor. The processor includes a program that analyzes a plurality of values of the parameter measured during a plurality of previous events so as to generate a predetermined threshold value and compares the received signal to a predetermined threshold value. The program then provides an output signal indicative of fluid influx when a received signal is beyond the predetermined threshold value. The measured parameter may comprise flow rate and/or volume.

The plurality of values of the parameter comprise at least one value of the parameter may be measured during each of at least 6 previous events.

Generation of each predetermined threshold value includes calculating the median and standard deviation as a function of time and summing the median and a multiple of the standard deviation. The multiple is preferably in the range of 2 to 3.

The system compares wherein real-time sensor values to the calculated thresholds and uses a cumulative sum of differences to indicate a false alarm rate. The system also calculates maximum allowable data variance values for at least one parameter and uses the allowable variance values as criteria for excluding measured data that falls outside the calculated allowable variances. The system also preferably includes means for receiving feedback and using the feedback to adjust subsequent calculations.

As used herein, "fluid" refers to liquid or gas and includes fluids pumped into the well and fluids entering the well from the formation.

BRIEF DESCRIPTION OF THE DRAWINGS

The FIGURE is a schematic diagram of a system in which the present invention could be implemented.

DETAILED DESCRIPTION OF A PREFERRED EMBODIMENT

Referring to FIG. 1, as is common in the art of hydrocarbon production, a borehole 10 extends into in an earth formation 12. An upper part of the bore wellbore 10 is provided with a casing 14 suspended from a wellhead 15 at the earth's surface 16. The casing 14 is fixed in the wellbore by a layer of cement 17 located between the wellbore wall and casing 14. Wellbore 10 has subsequently been drilled beyond the length of casing 14, forming an open hole section of wellbore 10. A tubing string 18 for injecting drilling fluid extends from a drilling rig 11 at surface, into wellbore 10. The lower end of tubing string 18 is provided with a drill bit 22.

During normal use, wellbore 10 is drilled to a certain depth, casing 14 is installed, and cement is pumped between casing 14 and the wellbore wall to form the layer of cement 17, and wellbore 10 is then further drilled to form a so-called open hole section. Tubing string 18 is lowered into wellbore 10 such that drill bit 22 is located at the bottom of wellbore 10. Drilling fluid, or mud, is then pumped down through the string 18 as shown at 21, flows out through bit 22, and returns to the surface via the annulus between tubing string 18 and the borehole wall or casing 14, as shown at 23. The returning fluid carries with it rock cuttings and any fluid that might have entered the open hole section of the wellbore.

Fluids flowing into and out of the well are handled by a mud system illustrated schematically at 25. Mud system 25 may include mud pits, flow lines, filters, pumps, settling or separation tanks, and the like, as is known in the art. Each component of mud system 25 may be equipped with one or more sensors (not shown), which in turn may measure one or more parameters including but not limited to the flow rate, pressure, volume, density, gas content, composition, or level of the fluid.

As mentioned above, in order to maximize the rate of drilling and avoid formation fluids entering the well, it is often desirable to maintain the bottom hole pressure in the annulus at a level that is slightly greater than the formation pore pressure. Drilling in this mode is referred to as overbalanced drilling. As bottom hole pressure increases, drilling rate typically decreases. If the bottom hole pressure increases to the point that it exceeds the fracture pressure of the formation surrounding the bottom of the borehole, a fracture can occur, as shown at 22. If fracturing occurs, cracks or fractures open in the borehole wall and the drilling fluid pressure more easily overcomes the formation pressure, which can result in fluid loss into the formation.

Fluid flow into the formation can reduce permeability and adversely affect production. In addition, once the formation has been fractured, returns flowing in the annulus, may exit the open wellbore, decreasing the weight of the fluid column in the well. If this occurs, the wellbore pressure can drop, allowing more formation fluids to enter the wellbore and causing a kick and potentially a blowout.

Similarly, if drilling is carried out with a bottom hole pressure below the formation pore pressure, referred to as underbalanced drilling, formation fluids may flow into the borehole, as shown at 24. If the formation fluids are less dense than the drilling fluid, replacement of the fluid column with formation fluid could cause a kick.

Kicks that occur while the mud pumps are stopped are particularly dangerous because many kick detection mechanisms depend on fluid return flow remaining below a manually pre-set alarm threshold value, and a different kick detection mechanism is required when return flow is expected to transition from normal pumps on return flow to zero return flow (over a period ranging from seconds to minutes) when pumps are turned off. In addition, the flow characteristics while pumps are off are influenced by variations in platform motion, wellbore expansion and contraction, and other factors that are difficult to model or predict. These influences make it more difficult to detect variations from normal that might indicate an influx event.

The present invention is an influx (kick) detection and alarm system that alerts oil/gas well drillers to an influx whenever the mud circulation pumps are stopped (pumps-off events) and transient return flow conditions exist.

In particular, the system uses machine learning techniques to merge multiple features calculated from data obtained from multiple sensor measurements during pumps-off events. The system automatically adapts the alarm settings as drilling conditions change and is designed to function without any manual adjustment of alarm settings.

For example, the median and standard deviation as a function of time are calculated for flow sensor and pit volume data acquired during a plurality of preceding pumps off events. The number of preceding pumps off events that provide the data is dependent on the duration and quality of data but is preferably 8 to 12 and more preferably 10 events. In each case, threshold values are calculated by summing the median and a multiple of the standard deviation. In preferred embodiments, the multiple is in the range of 2 to 3 so as to ensure low false alarm rates due to random variations. Upper threshold values are used to indicate possible influx events, while lower threshold values are preferably used to indicate bad data.

Real-time sensor values are then compared to the calculated temporal or sample dependent sensor thresholds and a cumulative sum of differences is calculated over the duration of the pumps off event. These cumulative sums are then also compared to separate thresholds (computed based on median and standard deviations of prior data) used to minimize false alarm rate. Specifically, if an out-of-limits value is detected; that is, when the cumulative sum of the differences between a predetermined number of sensor values and their respective temporal dependent limits (or thresholds) exceeds the corresponding cumulative sum threshold, as determined by medians and standard deviations of prior events as described previously, the value is treated as an influx alarm.

Similarly, the system preferably applies rules in order to exclude data that is determined to be derived from faulty sensors. For example, the system may calculate maximum allowable data variance values for various parameters, such as flow rate. In the event that measurements outside these variances are detected, the data is not included in the alert system and is preferably used as the basis for an equipment alert instead.

The system applies multiple feature extraction and fusion using recent pumps off events in order to generate a sample-to-sample sequence of required values (i.e. a curve or plot of limiting acceptable values applicable to each elapsed time since the start of the pumps-off event) for both flow and pit volume that must be observed to be within the calculated threshold tolerance levels or an alarm is generated indicating a possible influx event.

The duration of the "recent" window is determined by analyzing the associated data and selecting a window length that yields minimum error results. For some embodiments, a useful window length has been determined to be approximately 10 prior events. The window length is continuously optimized, so that the system is adaptive. As scenarios change at the well site the statistics of the new data alter the processing. For example, the optimal window length might shorten if a sequential series of long-duration normal pumps off events are observed or lengthen if a sequential series of abnormal pumps off events occur.

Thus, the system adaptively learns "normal" data patterns, i.e. the statistical median values of prior events are defined as normal so that detection is based on unusual deviation (i.e. greater than the measured standard deviation) from prior data for the current operational scenario.

The sample-to-sample thresholds or limits represent acceptable or "normal" temporal patterns (i.e. levels versus time since pumps-off) applied to determine non influx or "normal" pumps-off events when deviations are generally lower than (median+M x) standard deviation, where M is a multiple of standard deviation and is x set to a value of 2 or more depending on the acceptable false alarm rates (i.e. alarms when the pumps off data does not represent an influx event).

In addition to the adaptive processing that allows the system to learn the characteristics of prior data as described above, the present system also preferably includes an option for a user to input feedback identifying possible bad data or errors in detection or diagnosis made by the system. These inputs are stored for later analysis to determine possible changes in thresholds or bad data criteria to prevent these same errors from occurring in the future. For example, if a new flow sensor is deployed and is found to have a unique problem (such as periodic spikes) not seen or anticipated, these data would be recorded and notated by the user and future modifications would include this pattern as indicative of invalid data, thus preventing false alarms.

By using an appropriate number of recent events as a basis for thresholding current events, the system adapts to dynamic changes in drilling scenarios such changes in well depth, formation breathing and or floating rig heave conditions for offshore wells. Thus, a detection process that maintains "optimum" performance is achieved in the sense that probability of detecting influx is maximized while false alarms (triggered by non-influx events) are minimized. A key advantage is that no human interaction is required for the system to maintain the threshold curves applied to the data as these adapt automatically.

The present invention provides effective automatic detection of influx during pumps-off events without requiring operator intervention. The system maintains a lowest-possible false alarm rate and is robust against many sensor failure modes. For example, a stuck paddle flow meter condition will be detected when a maximum allowable data variance is exceeded, whereupon the system will automatically discard the bad sensor data. By providing an automated technique for influx detection at pumps-off events, the present invention has the potential to make significant improvements in influx detection, and thus significantly improve safety and reduce cost.

What is claimed is:

1. An automated system for detecting fluid influx into a wellbore, comprising: at least one sensor for measuring at least one or more parameters related to fluid entering or exiting the well; and a processor for receiving a signal indicative of said parameter from the sensor, said processor including a program embodied on a non-transitory computer readable medium that compares the received signal to a predetermined threshold value, wherein the program analyzes a plurality of values of the parameter measured during a plurality of previous events so as to generate the predetermined threshold value; and providing an output signal indicative of fluid influx from the formation into the well when the received signal is beyond the predetermined threshold value wherein the measured one or more parameters comprises flow rate and volume.

2. The system according to claim 1 wherein the plurality of values of the parameter comprise at least one value of the parameter measured during each of at least 5 previous events.

3. The system according to claim 1 wherein generate the predetermined threshold value includes calculating the median and standard deviation as a function of time and summing the median and a multiple of the standard deviation.

4. The system according to claim 3 wherein the multiple is in the range of 2 to 3.

5. The system according to claim 1 wherein the program is configured such that an influx alarm results when a cumulative sum of the differences between a predetermined number of sensor values and their respective temporal dependent thresholds exceeds a corresponding cumulative sum threshold.

6. The system of claim 5 wherein the corresponding cumulative sum threshold is determined using medians and standard deviations of prior data.

7. The system according to claim 1 wherein the program also calculates maximum allowable data variance values for at least one parameter and uses said allowable variance values as criteria for excluding measured data that falls outside the calculated allowable variances.

8. The system of claim 7 wherein the program uses the allowable variance values to automatically exclude measured data that falls outside the calculated allowable variances without human interaction.

9. The system according to claim 1 wherein the analysis of the measured parameter includes applying a pattern recognition algorithm and wherein the pattern recognition algorithm includes feature extraction and fusion.

10. The system according to claim 9 wherein a pattern recognized by the pattern recognition algorithm is reported to the user.

11. The system according to claim 1 wherein the program includes means for receiving feedback and using the feedback to adjust subsequent calculations.

12. The system of claim 1 wherein the program merges multiple features calculated from data obtained from multiple sensor measurements.

13. The system of claim 12 wherein one of the sensor measurements includes volume.

14. The system of claim 12 wherein one of the sensor measurements includes flow rate.

15. The system of claim 1 wherein the program applies rules in order to exclude data that is determined to be derived from one or more faulty sensors.

16. The system of claim 15 wherein the program adaptively processes excluded data.

17. The system of claim 15 wherein excluded data is adaptively processed and used to change one or more thresholds or bad data criteria.

18. The system of claim 1 wherein the program detects unusual deviation from prior data for an operational scenario using statistical median values of prior events.

19. The system of claim 1 wherein the program analyzes associated data and selects a window length of a number of events that yields minimum error results.

20. The system of claim 19 wherein the window length is adaptively optimized.

21. An automated system for detecting fluid influx into a wellbore, comprising: at least one sensor for measuring at least one or more parameters related to fluid entering or exiting the well; and a processor for receiving a signal indicative of said parameter from the sensor, said processor including a program embodied on a non-transitory computer readable medium that compares the received signal to a predetermined threshold value, wherein the program analyzes a plurality of values of the parameter measured during a plurality of previous events so as to generate the predetermined threshold value; and providing an output signal indicative of fluid influx from the formation into the well when the received signal is beyond the predetermined threshold value wherein the measured one or more parameters comprises flow rate, volume, or both; wherein the program:

applies rules in order to exclude data that is determined to be derived from one or more faulty sensors.

22. An automated system for detecting fluid influx into a wellbore, comprising: one or more sensors for measuring at least one or more parameters related to fluid entering or exiting the well; and a processor for receiving a signal indicative of said parameter from the sensor, said processor including a program embodied on a non-transitory computer readable medium that compares the received signal to a predetermined threshold value, wherein the program analyzes a plurality of values of the parameter measured during a plurality of previous events so as to generate the predetermined threshold value; and providing an output signal indicative of fluid influx from the formation into the well when the received signal is beyond the predetermined threshold value wherein the measured one or more parameters comprises flow rate, volume, or both; wherein the program is configured such that an influx alarm results when a cumulative sum of the differences between a predetermined number of sensor values and their respective temporal dependent thresholds exceeds a corresponding cumulative sum threshold.

* * * * *